US007640879B2

(12) United States Patent
Lau

(10) Patent No.: US 7,640,879 B2
(45) Date of Patent: Jan. 5, 2010

(54) PRESSER FOOT

(75) Inventor: Wai Ching Andy Lau, Hong Kong (HK)

(73) Assignee: Clover Group International Limited, Kowloon (HK)

( * ) Notice: Subject to any disclaimer, the term of this patent is extended or adjusted under 35 U.S.C. 154(b) by 0 days.

(21) Appl. No.: 11/863,671

(22) Filed: Sep. 28, 2007

(65) Prior Publication Data

US 2008/0078314 A1 Apr. 3, 2008

Related U.S. Application Data

(60) Provisional application No. 60/827,219, filed on Sep. 28, 2006.

(51) Int. Cl.
*D05B 29/02* (2006.01)
*D05B 29/00* (2006.01)

(52) U.S. Cl. ..... 112/235

(58) Field of Classification Search ..... 112/235–240, 112/272

See application file for complete search history.

(56) References Cited

U.S. PATENT DOCUMENTS

| | | | | | |
|---|---|---|---|---|---|
| 1,406,760 | A | * | 2/1922 | Rudolph | 219/243 |
| 2,473,236 | A | * | 6/1949 | Barlow | 112/235 |
| 2,640,798 | A | * | 6/1953 | Langer | 156/176 |
| 2,666,472 | A | * | 1/1954 | Hosfield | 156/380.5 |
| 3,619,334 | A | * | 11/1971 | Hauf et al. | 156/581 |
| 4,067,276 | A | * | 1/1978 | Mohilo et al. | 112/220 |
| 4,823,713 | A | * | 4/1989 | Ogawa et al. | 112/217 |
| 4,870,916 | A | * | 10/1989 | Kozawa et al. | 112/470.02 |
| 4,953,486 | A | * | 9/1990 | Sano et al. | 112/447 |
| 6,301,859 | B1 | * | 10/2001 | Nakamura et al. | 53/373.7 |

FOREIGN PATENT DOCUMENTS

| | | | | |
|---|---|---|---|---|
| CN | 87214008 | U | | 10/1988 |
| CN | 2088557 | U | | 11/1991 |
| GB | 739661 | | | 11/1955 |
| JP | 407016372 | A | * | 1/1995 |
| JP | 8155166 | A | | 6/1996 |
| JP | 2000317181 | A | | 11/2000 |

OTHER PUBLICATIONS

Sipo, "Search Report and Written Opinion for PCT/CN2007/002842", Jan. 3, 2008, Publisher: International Searching Authority.

* cited by examiner

*Primary Examiner*—Ismael Izaguirre
(74) *Attorney, Agent, or Firm*—George G. Wang; Wilkinson & Grist

(57) ABSTRACT

A fabric-processing device includes a body, a presser foot attached to the body, and a heater attached to the presser foot. The heater is in a heat-exchange relationship with the presser foot.

14 Claims, 4 Drawing Sheets

PRESSER FOOT

CROSS REFERENCE TO RELATED APPLICATION

Pursuant to 35 U.S.C. 119(e), this application claims priority to U.S. Provisional Application No. 60/827,219, filed Sep. 28, 2006, the contents of which are hereby incorporated herein by reference.

BACKGROUND

Seams and hems in articles of clothing generally include stitching formed by electric sewing machines. Even though the electric sewing machines facilitate rapid manufacture, they cannot provide a flat and smooth appearance to the finished articles.

Seams and hems with a flat and sheer appearance may be achieved using thermally sensitive adhesive film tapes, ribbons, or other heat-fusing means between the layers of fabric, in which a pneumatic bonding machine or hot iron may be used to apply heat and pressure along the fabric edge. Although thermal fusing may achieve a good sheer appearance, the process involved is time consuming, and pneumatic bonding machines are expensive. Moreover, pneumatic bonding machines direct a stream of heated air through a nozzle at the area to be joined, and the stream of heated air may be adversely affected by ambient conditions, such as air temperature and airflow, on the factory floor.

Consequently, it is desirable to provide a fabric-processing device with a presser foot for applying heat to a material. This is analogous to a conventional presser foot that provides stitching to a material. It is also desirable to provide a sewing machine that can provide heat-fused hems and seams.

SUMMARY

According to one aspect, a fabric-processing device includes a body, a presser foot attached to the body, and a heater attached to the presser foot. The heater is in a heat-exchange relationship with the presser foot.

According to another aspect, a method of fusing an article of clothing includes laying a sheet of fabric under a presser foot of a fabric-processing device, and operating said fabric processing device to fuse the sheet of fabric. The fabric-processing device includes a heater in a heat-exchange relationship with the presser foot.

DETAILED DESCRIPTION

Reference will now be made in detail to a particular embodiment of the invention, examples of which are also provided in the following description. Exemplary embodiments of the invention are described in detail, although it will be apparent to those skilled in the relevant art that some features that are not particularly important to an understanding of the invention may not be shown for the sake of clarity.

Furthermore, it should be understood that the invention is not limited to the precise embodiments described below, and that various changes and modifications thereof may be effected by one skilled in the art without departing from the spirit or scope of the invention. For example, elements and/or features of different illustrative embodiments may be combined with each other and/or substituted for each other within the scope of this disclosure and appended claims. In addition, improvements and modifications which may become apparent to persons of ordinary skill in the art after reading this disclosure, the drawings, and the appended claims are deemed within the spirit and scope of the present invention.

There is disclosed herein a fabric-processing device, which includes a presser foot for attachment to the fabric-processing device, and an electric heater in heat-exchange relationship with the presser foot for transferring thermal energy thereto.

Figure 1:
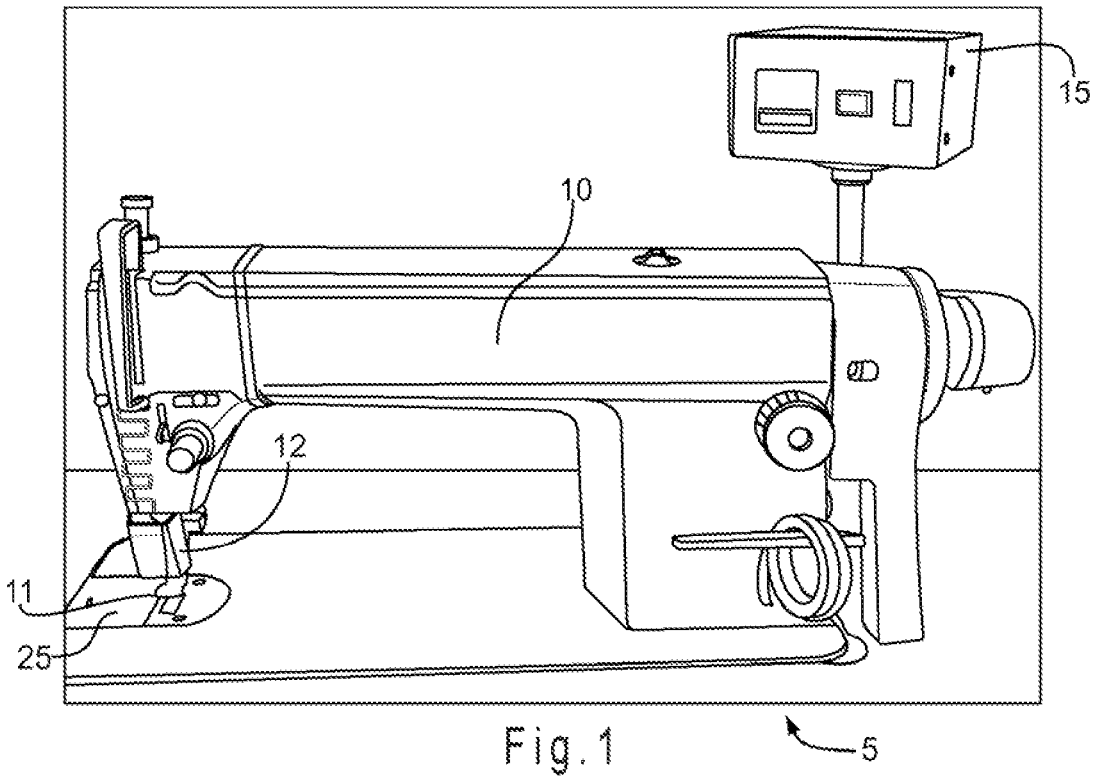
FIG. 1 depicts a presser foot attached to a fabric-processing device.
Figure 2A:
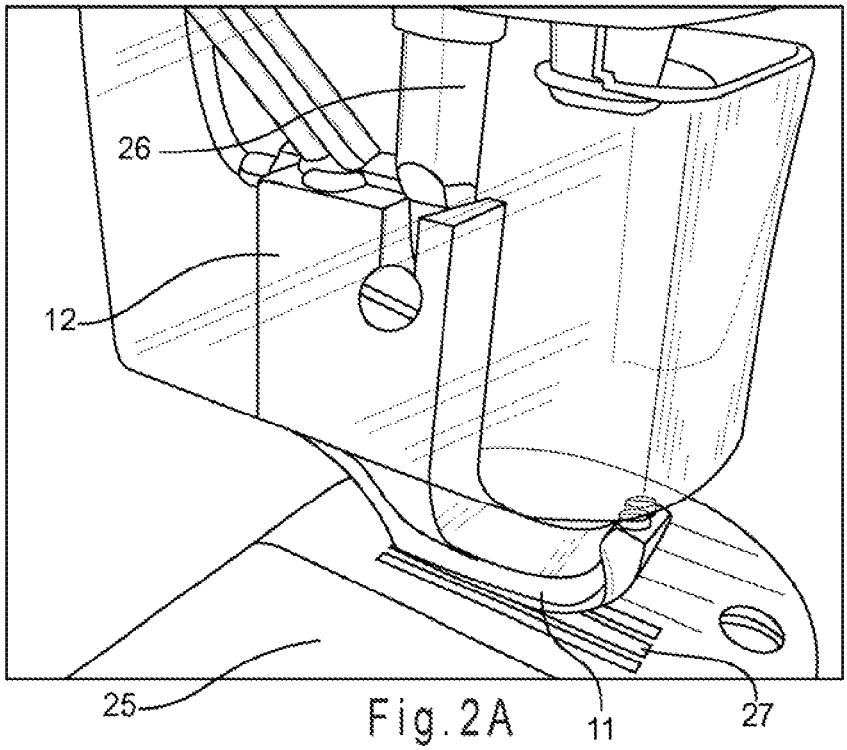
FIG. 2A depicts a close-up view of the presser foot of FIG. 1.
Figure 2B:
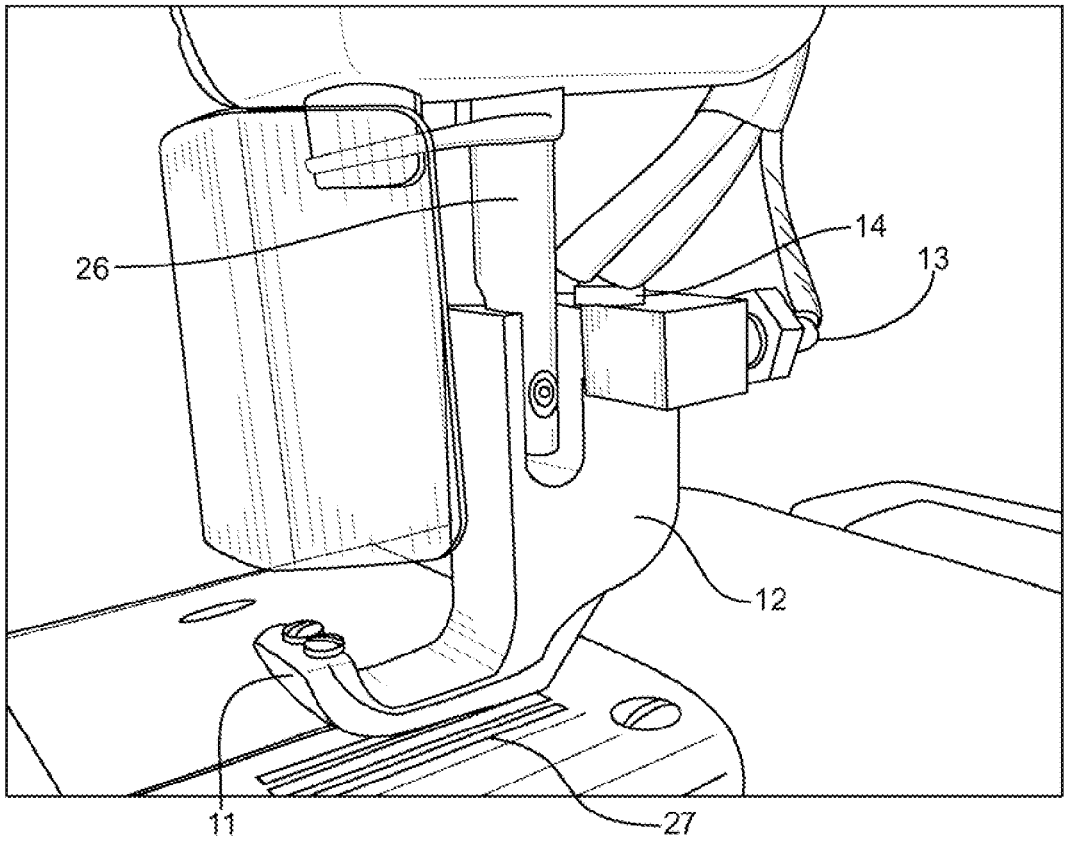
FIG. 2B depicts another close-up view of the presser foot of FIG. 1.

A fabric-processing device 5 includes a body 10, a presser foot 12 attached to the body 10, a presser foot bar 26 attached to the presser foot 12, and a control box 15 attached to the body 10, as depicted in FIGS. 1, 2A and 2B. A clamp may be used to attach the presser foot bar 26 above an unconnected slide plate 25. No needle bar or needle may be needed in the fabric-processing device 5.

The fabric-processing device 5 may drive the presser foot bar 26 to reciprocate vertically during use. The presser foot bar 26 may also reciprocate the presser foot 12 vertically, as a feed dog 27 beneath the slide plate 25 reciprocates substantially horizontally to draw a sheet of fabric forward, as depicted in FIGS. 2A and 2B.

The presser foot 12 may be attached to the presser foot bar 26 at a location similar to the location where a standard twin-skid presser foot would ordinarily be fitted for sewing. In one example, the presser foot 12 may be formed integrally with the presser foot bar 26. In another example, the presser foot 12 may include a clamp for attachment to the presser foot bar 26. The presser foot 12 may have a single-skid construction. For example, the presser foot 12 may include a skid 11, as depicted in FIGS. 1 and 2.

Figure 2C:
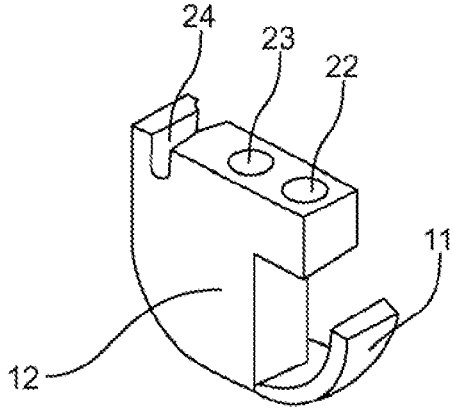
FIG. 2C depicts a schematic of the presser foot of FIG. 1.
Figure 3:
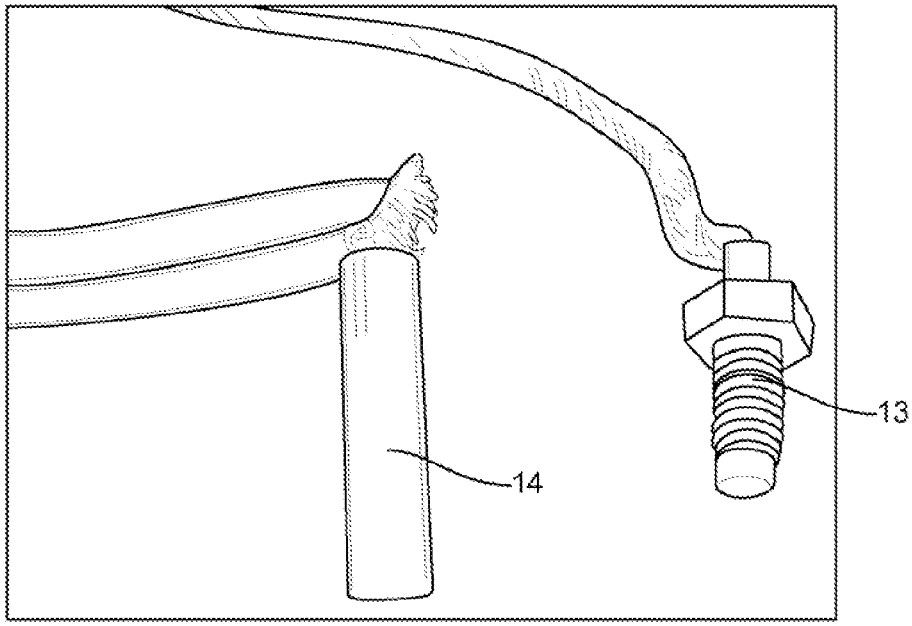
FIG. 3 depicts a thermocouple and a heater to be used in a presser foot.
Figure 4:
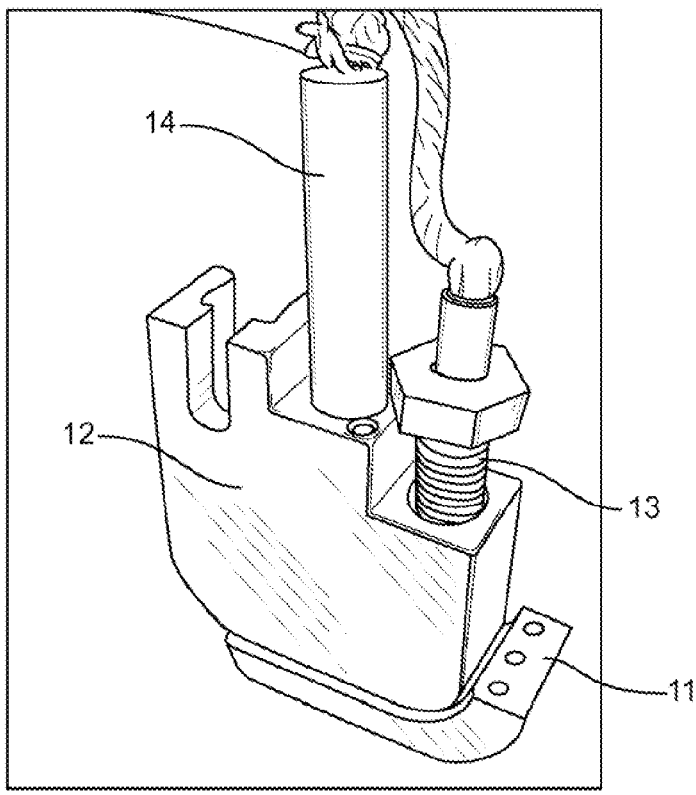
FIG. 4 depicts the thermocouple and the heater of FIG. 3 as used in a presser foot.

The presser foot 12 includes a first recess 22 for receiving a temperature sensor 13 and a second recess 23 for receiving a heater 14, as depicted in FIGS. 2C, 3 and 4. For example, the temperature sensor 13 may be a thermocouple. The temperature sensor 13 may be in a heat-exchange relationship with the presser foot 12 for providing a means of controlling electrical input to the heater 14.

The presser foot 12 may also include a clamp recess 24 configured to attach to the presser foot bar 26 of a fabric-processing device 5, as depicted in FIG. 2C. The presser foot 12 may be made of metallic material such as stainless steel, carbon steel, chrome plated brass or combinations thereof. The presser foot 12 may be used on both flat (2-D) materials, such as dresses, as well as on contoured (3-D) materials, such as brassiere cups.

Figure 5:
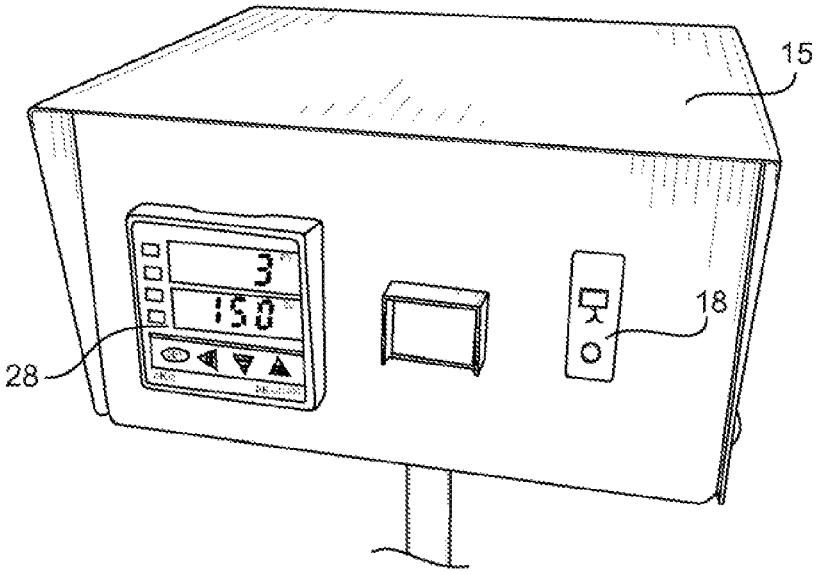
FIG. 5 depicts a control box of the fabric processing device of FIG. 1 used to operate the presser foot.

The temperature sensor 13 may include a threaded shaft configured to be internally threaded into the recess 22, as depicted in FIGS. 2C, 3 and 4. The heater 14 may be cylindrical in shape and configured to fit into the recess 23 to achieve good heat transfer with the presser foot 12. For example, heat of the presser foot 12 may be relayed to the skid 11 by conduction. The control box 15 may include a microswitch 18 and a display/control panel 28 configured to set and display the desired temperature of the presser foot 12, as depicted in FIG. 5.

Figure 6:
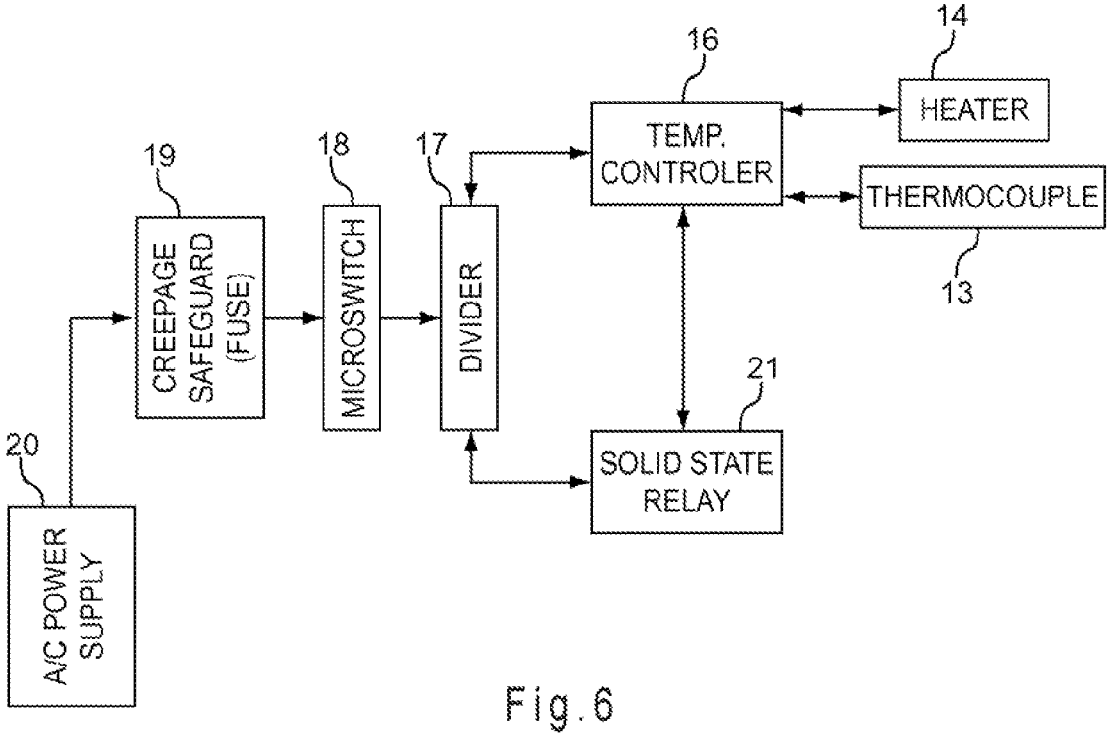
FIG. 6 depicts a schematic circuit block diagram of the control box of FIG. 5.

The internal circuitry of the control box 15 may be as depicted in FIG. 6. A microswitch 18 may receive power from an AC power supply 20 through an earth leakage detector or a fuse 19. The microswitch 18 may pass the power through a divider 17 to a solid-state relay 21 and a temperature controller 16. The temperature controller 16 may be connected electrically to both the temperature sensor 13 and the heater 14.

During use of the fabric-processing device 5, the temperature controller 16 may continuously monitor the output of temperature sensor 13 to adjust the delivery of current to the heater 14, such as by providing a continuously variable current. Current may be switched to the heater 14 depending upon the input from the temperature sensor 13. In another example, an ON/OFF thermostat may be used to control the heater 14, to provide a thermal mass sufficient to prevent rapid changes in the temperature of the presser foot 12. This may be advantageous for a larger presser foot.

To operate the fabric-processing device 5, the microswitch 18 may be activated, and the presser foot 12 may be given sufficient time to heat up to a temperature set by the user at the control panel 28. An adhesive film tape may then be laid down between layers of fabric in a garment, where the fabric may be positioned upon the slide plate 25 beneath the presser foot 12.

The fabric-processing device 5 may then be treadle-operated so that heat from the heater 14 of the presser foot 12 may be transferred through the fabric to the adhesive film to fuse the film to the fabric and form a smooth sheer hem or seam, as the feed dog 27 draws the fabric forward. As the presser foot 12 reciprocates vertically during use, excessive heat may be kept away from the adhesive film. When the fabric-processing device 5 stops, the presser foot 12 may come to rest in a raised position. Consequently, the presser foot 12 may be used in a sewing machine to thermally fuse seams in clothing without the need for stitching.

It should be appreciated that modifications and alterations obvious to those skilled in the art are not to be considered as beyond the scope of the present invention.

While the examples of the methods and products have been described, it should be understood that the methods and products are not so limited, and modifications may be made. The scope of the method and products is defined by the appended claims, and all methods and products that come within the meaning of the claims, either literally or by equivalence, are intended to be embraced therein.

What is claimed is:

1. A fabric-processing device, comprising:

a body;

a presser foot attached to said body;

a heater attached to said presser foot;

a first recess for receiving said heater; and a control box attached to said body, wherein said heater is in a heat-exchange relationship with said presser foot; and said control box further comprises a divider for power to pass through to reach a solid-state relay and a temperature controller.

2. The fabric-processing device of claim 1, further comprising a presser foot bar attached to said presser foot and configured to reciprocate said presser foot vertically.

3. The fabric-processing device of claim 2, wherein said presser foot comprises a clamp for attachment to said presser foot bar.

4. The fabric-processing device of claim 2, wherein said presser foot is formed integrally with said presser foot bar.

5. The fabric-processing device of claim 1, wherein said presser foot comprises a second recess for receiving a temperature sensor.

6. The fabric-processing device of claim 5, wherein said temperature sensor is a thermocouple.

7. The fabric-processing device of claim 1, wherein said control box comprises a microswitch configured to receive power from an AC power supply.

8. The fabric-processing device of claim 1, wherein said control box further comprises a display/control panel configured to set and display the desired temperature of said presser foot.

9. The fabric-processing device of claim 1, wherein said temperature controller is connected electrically to said heater.

10. The fabric-processing device of claim 1, wherein said presser foot further comprises a skid.

11. The fabric-processing device of claim 1, wherein said presser foot is made of metallic material.

12. The fabric-processing device of claim 11, wherein said metallic material is selected from the group consisting of stainless steel, carbon steel, chrome plated brass, and combinations thereof.

13. A method of fusing an article of clothing, comprising:

laying a sheet of fabric under a presser foot of a fabric-processing device; and operating said fabric-processing device to fuse said sheet of fabric, wherein said fabric-processing device comprises a heater in a heat-exchange relationship with said presser foot, said presser foot comprises a recess for receiving said heater, and said fabric-processing device further comprises a control box comprising a divider for power to pass through to reach a solid-state relay and a temperature controller.

14. The method of claim 13, further comprising activating a microswitch of said control box to heat up said heater.

* * * * *